United States Patent [19]

Bloomer

[11] 4,279,196

[45] Jul. 21, 1981

[54] PAINT SPRAY BOOTH WITH SILENCER MEANS

[75] Inventor: Ivan Bloomer, London, England

[73] Assignee: Carrier Drysys Limited, London, England

[21] Appl. No.: 111,157

[22] Filed: Jan. 11, 1980

[51] Int. Cl.[3] ..... B05C 15/00

[52] U.S. Cl. ..... 98/115 SB; 55/240; 55/276; 55/DIG. 46; 98/DIG. 10

[58] Field of Search ..... 98/115 R, 115 SB, DIG. 10; 55/240, 276, DIG. 46; 261/112

[56] References Cited

U.S. PATENT DOCUMENTS

| | | | |
|---|---|---|---|
| Re. 21,519 | 7/1940 | Norris | 55/276 X |
| 2,037,884 | 4/1936 | Day | 55/276 X |
| 3,690,044 | 9/1972 | Boresta | 261/112 X |
| 3,757,892 | 9/1973 | Raudman, Jr. | 55/276 X |
| 3,934,495 | 1/1976 | Bloomer | 98/115 SB |
| 4,045,524 | 8/1977 | Borhert | 98/115 SB X |
| 4,144,041 | 3/1979 | Hov | 261/112 X |
| 4,162,904 | 7/1979 | Clay et al. | 55/276 |

*Primary Examiner*—Albert J. Makay
*Assistant Examiner*—Harold Joyce
*Attorney, Agent, or Firm*—Krass, Young & Schivley

[57] ABSTRACT

The invention provides a paint spray booth of the kind having an enclosed chamber defining a working area with a perforate working floor. A sub-floor located beneath the working floor has an opening, or a series of openings, through which air from the working area is extracted together with a scrubbing liquid with which the sub-floor is continuously flooded. According to the invention, sound-deadening means for reducing noise within the working area is located beneath the working floor, and these means comprise, generally, a sound-reflecting baffle plate fitted on one surface with an acoustic material. In a particular form of the invention, the openings comprise tubular outlet structures having downwardly-depending wall members, and the baffle plate surrounds the wall members in the form of a jacket, the acoustic material being disposed within the space formed between the wall members and the jacket. The wall members are perforated to allow sound to pass through into the acoustic material.

A booth constructed in accordance with the invention has significantly lower noise levels within the working area than in prior art booths.

13 Claims, 4 Drawing Figures

PAINT SPRAY BOOTH WITH SILENCER MEANS

BACKGROUND OF THE INVENTION

This invention relates to paint spray booths, and more particularly to sound deadening apparatus for paint spray booths.

A related prior art spray booth is shown in U.S. Pat. No. 3,421,293, Halls, to comprise an enclosed chamber through which the articles to be painted are passed. The working floor of the booth consists of a flat grating beneath which is located a sub-floor. The sub-floor is continuously flooded with water during operation of the booth, and this water is removed from the booth, together with the paint-contaminated air, through a series of spaced outlet structures such as tubes which depend downwardly from the sub-floor toward a water trough or channel.

The turbulence generated in the air and the water during passage through the tubes assists in transferring the solid paint particles from the air into the water, and the water is then discharged into the trough. Paint is subsequently removed from the water in a flotation tank or similar treatment apparatus at one end of the trough. This turbulence does however generate a substantial amount of noise, and more noise is produced by the fans which are operated continuously to remove the air from the booth. As a result, noise levels within the booth chamber can be considerable.

It is an object of the present invention to provide a paint spray booth in which operational noise levels within the booth chamber are significantly reduced in comparison with prior art spray booths.

It is a further object of the invention to provide an outlet structure for location in fluid communication with the sub-floor of a paint spray booth which reduces noise levels within the booth chamber.

SUMMARY OF THE INVENTION

According to the present invention, there is provided a paint spray booth comprising an enclosed chamber defining a working area, a perforate working floor, means for supplying air to the working area and for causing a flow of air from the working area downwardly through the perforate working floor, a sub-floor beneath and spaced from the perforate working floor, means for continuously flooding the sub-floor with a scrubbing liquid such as water, and one or more openings in the sub-floor through which the scrubbing liquid and air can be extracted; and sound-deadening means operable to reduce noise levels within the working area during operation of the booth, said sound-deadening means being located below the perforate working floor and comprising sound-reflecting baffle means and, disposed adjacent at least one surface thereof, a sound-absorbing material in direct sonic proximity to the scrubber opening to receive and absorb sound therefrom.

As will be described, various arrangements of sound-deadening means are possible according to the invention, and the construction and location of these means will depend on the design and the noise-reduction requirements of the spray booth in question. In one form, the sound-deadening means comprises one or a series of baffle plates extending in the space between the working floor and the sub-floor, the or each baffle plate being provided with a layer of sound-absorbing acoustic material applied to one surface. The or each baffle plate is arranged with the sound-absorbing material located on the lower surface of the baffle opposite the opening or openings in the sub-floor.

Suitably, the baffle plates comprise inverted channel-section members with the acoustic material disposed within the channels, and these members may be disposed either with their edges abutting or spaced from each other to minimise resistance to air flow. They may extend over the full lateral or longitudinal extension of the booth or alternatively, where a series of extract openings are provided, they may be located in groups immediately above each opening.

In one preferred embodiment, several of these baffle plates are provided spaced from each other and extending transverse to the longitudinal centre-line of the booth with their longitudinal axes arranged in a substantially horizontal plane. These baffles are preferably tilted laterally about their longitudinal axes so as to provide a slatted effect and thereby minimise resistance to air flow.

Advantageously, the exposed surface of the sound-absorbing material is faced with a lower wall of perforate sheet material which retains the sound-absorbing material in position against the sound-reflecting baffle plate and which reduces the possibility of the acoustic material becoming wetted. The perforations are provided in the facing sheet to enable sound to pass through the sheet and into the sound-absorbing material.

In a further development of the invention, a protective layer of water-impervious material is provided either alternatively or in addition to the perforate sheet material to prevent wetting of the sound-absorbing material during operation. Wetting caused by ingress of the scrubbing liquid into the sound-absorbing material substantially reduces the efficiency of the material during operation.

The use of sound-absorbing means in the form described above has been found to provide a reduction in the noise level within the booth enclosure of at least 3 dB(A).

In the case where the booth is provided with extract openings spaced along the longitudinal axis of the booth, the sound-deadening means can be designed specifically to reduce noise emitted through each opening. In one such arrangement, the sound-deadening means comprises individual noise attenuators located above some or all of the openings in the space between the sub-floor and the working floor.

Suitably, each noise attenuator has a baffle plate of e.g. sheet metal forming a generally pyramidical or conical outer casing; however, any shape which reduces in section towards its upper end can be used, such as a frusto-cone or hemisphere or a combination of the aforesaid shapes. The casing forms an enclosure reducing in cross-section towards the top, and open at the base. The acoustic material is disposed within the enclosure, where it may be held in place by the perforate sheet material.

Preferably, the diameter or width of each attenuator at the base thereof is slightly greater than the diameter or width of the corresponding opening so as to ensure maximum coverage of noise emitted therefrom.

With all these embodiments described above, liquid (e.g. water) supply means are preferably associated with each sound-deadening means adapted to flood scrubbing liquid onto the upper surfaces of the baffle plate during operation of the booth so as to prevent contamination of the upper surfaces with paint solids.

The use of the individual noise attenuators, or the channel-shaped baffle plates described above, substantially reduces the noise level in the booths during operation, as the combination of the acoustic material and the baffle acts as a noise barrier to sound emitted from the opening or openings in the sub-floor.

It has been found that, where the openings are of suitable form and terminate in outlet structures having downwardly-depending wall members, similar reductions in noise level can be achieved by fitting the sound-deadening means around the outside surfaces of the wall members themselves.

Accordingly, in another embodiment of the invention, the sound-reflecting baffle is in the form of an outer jacket surrounding either wholly or partially the respective wall members, and the sound-absorbing material is disposed in the space defined between the outer jacket and the wall members. This requires the wall members to be perforate or made of a material through which sound may easily penetrate. Such an arrangement is particularly effective where the outlet structures are individual extract tubes. Advantageously, the extract tube itself is formed from a perforate sheet material to allow noise penetration into the sound-absorbing material; a water-impervious membrane can be provided between the walls of the tube and the sound absorbing material to prevent wetting of the material during operation.

This design of sound-deadening means is highly effective in reducing overall noise levels in the booth, and as the baffle is not located in the space between the working floor and the sub-floor, it does not restrict air flow towards the tubes and does not become contaminated with paint during operation. Further, this arrangement requires less modification to the interior structure of the booth itself.

As an alternative, or in addition to the waterproof envelope, each downwardly-depending wall member may be formed from sheet material which is shaped around the apertures therein to prevent the scrubbing liquid which travels downwardly via the respective opening from passing through said apertures.

In another aspect, the invention provides an outlet structure for the sub-floor of a paint spray booth, comprising a pair of opposite, downwardly-depending wall members formed from a perforate sheet material, a baffle plate spaced from and extending in substantially the same direction as each said wall member to define a space between said wall member and said baffle plate, and a sound-absorbing acoustic material disposed in said space to reduce sound passing through the openings formed in said wall member.

DESCRIPTION OF THE PREFERRED EMBODIMENTS

Figure 1:
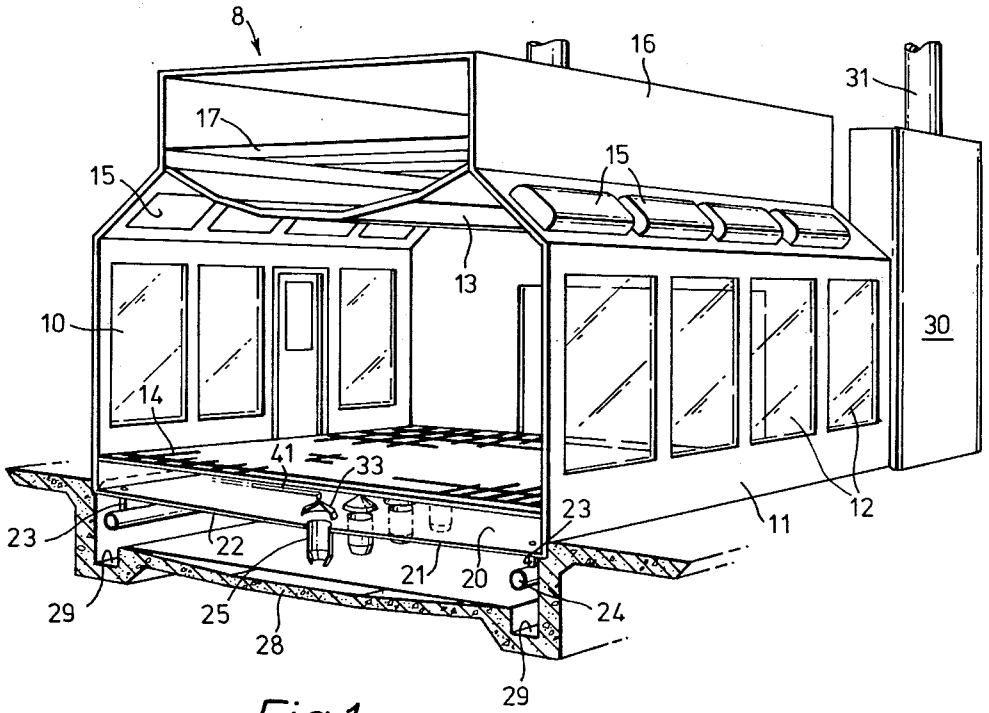
FIG. 1 shows a perspective view, partly in section, of a water-washed spray booth fitted with sound-deadening means in accordance with the invention.

Referring to the drawings, FIG. 1 shows a paint spray booth 8 suitable for example for automobile vehicles, which comprises an enclosed chamber 10 defined by walls 11, a ceiling 13, and a working floor 14 composed of an open grating which preferably extends the full width of the booth. The walls are fitted with windows 12 and overhead lights 15, and air is supplied to the interior of the chamber through supply ducting 16 and adjustable slats 17.

In known manner, the booth is provided with a sub-floor 20 spaced from and beneath the working floor 14. The subfloor consists of two slightly inclined plane surfaces, 21, 22 which slope towards the centre-line of the booth. During operation of the booth, these surfaces are continuously wetted by water supply pipes 23 located at intervals along the upper margins of the surfaces. The water supply pipes 23 communicate with a conduit 24 extending beneath the sub-floor.

Water and air are extracted from the booth through a series of spaced outlet structures in the form of extract tubes 25 arranged along the centre-line of the booth. In the embodiment illustrated, these are of cylindrical section, although it will be appreciated that they may be of any suitable cross-section such as rectangular or square, and may be provided with any suitable air disturbing means for enhancing the turbulent intermixing of air and water, and the resulting scrubbing action. Such means include vanes, baffles, constrictions, and other known devices.

The water running over the surfaces 21, 22 catches the paint overspray passing through the working floor 14, and further paint particles remaining in the air are removed in the mixing action which takes place within the extract tubes. The contaminated water is left in a pond formed over the base 28 and is removed via channels 29. The clean air is exhausted to atmosphere via fan housing 30 and stack 31.

At the air flow rates required for extremely efficient overspray removal, high noise levels can be generated within the chamber 10 both by the fans in housing 30 and also as a result of the mixing action which occurs within the extract tubes 25. This noise can rise to such a level that working conditions within the chamber 10 become uncomfortable. Tests have shown that this noise passes into the booth enclosure substantially through the extract tubes 25. In order to reduce the noise level within the booth, in accordance with the invention, each extract tube 25 in FIG. 1 is fitted with an individual noise attenuator 33.

Figure 2:
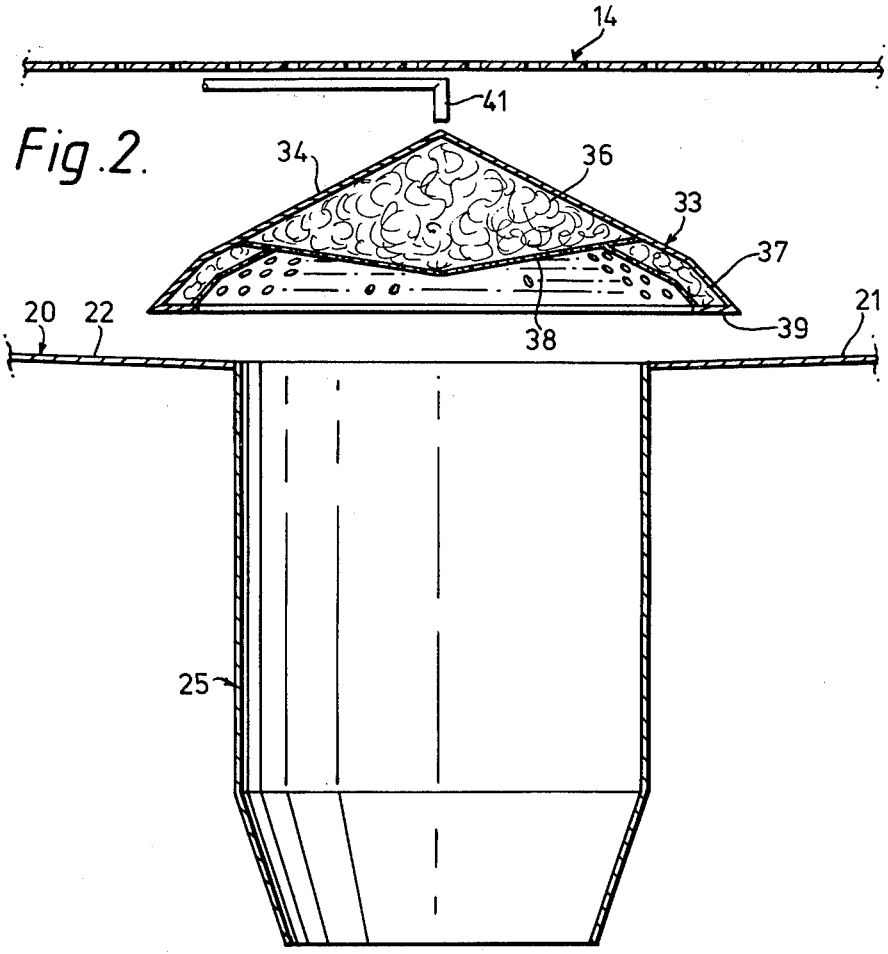
FIG. 2 is an enlarged vertical cross-section of one extract tube and associated noise attenuator of the booth of FIG. 1.

One of these noise attenuators is shown in detail in FIG. 2. It comprises baffle plate forming a sound-reflective outer shell 34 of substantially conical shape constructed for example for mild steel sheet and mounted within the space between the working floor 14 and the subfloor 20, directly above the mouth of the respective extract tube 25. The configuration of the base of the noise attenuator 33 preferably corresponds substantially to the shape of the extract tube, e.g. if the tube is of circular section, as shown in FIG. 2, the attenuator is conical or frusto-conical; if the extract tube is square-section the attenuator will have a four-sided pyramid shape. As will be seen from FIG. 2, the outer margins of the attenuator base extend beyond the effective diameter of the extract tube in order to ensure that all noise passing through the tube is intercepted by the attenuator casing.

The sound-reflecting casing 34 defines an enclosure which is provided with a layer of sound-absorbing acoustic material 36 which substantially fills the upper part of the casing and which extends around the lower margins at 37.

This material is for example a bulked fibrous acoustic material such as a mineral fibre or a glass fibre; the preferred material is that sold under the Registered Trade Mark STILLITE SR10. The acoustic material 36 is held in position within the casing 34 by means of a perforate inner wall 38 of e.g. expanded metal sheet, a wire grid or thin sheet steel which is perforated to provide a suitably chosen free area to allow for sound penetration. The configuration of the inner wall and its free area will be chosen to suit the frequencies to be absorbed but preferably the inner wall should have a minimum free area of 10%. Where perforate metal sheet is used, the perforations should have a minimum diameter of 1 mm. As an example, 3 mm perforations have been used spaced to give a 30% free area.

The perforate wall 38 allows the sound to pass into the sound absorbing material 36, where certain frequencies are absorbed. Further absorption takes place when the noise is reflected off the inside of the casing 33 and returned into the acoustic material 36. By a suitable choice of acoustic material, selective sound frequencies can be absorbed so as to further reduce the apparent noise levels within the booth.

In order to prevent contamination of the outer surfaces of the casing 34 with solid paint particles entrained in the air passing towards tube 25, a water supply pipe 41 is provided to flood the outer surface of the attenuator with water during operation of the booth. This water supply pipe 41 may be connected to the conduits 25 beneath the booth floor. By directing the water supply pipe 41 at the apex of the casing 34, full wetting of the casing is ensured.

In order to prevent water penetration into the acoustic material 36 within the casing 34, the perforated inner wall 38 terminates at a point 39 spaced from the lower edge of the casing, and the casing is bent over at its margins to provide a drip point. Wetting of the acoustic material can be eliminated completely by covering the inner wall 38 either on its inside or its outside surface with a layer of water-impervious material such as a flexible sheet plastics material.

Each attenuator is supported in the space between the floors 14 and 20 in such a manner as to provide maximum sound absorption with minimum resistance to air flow. Typically, the attenuator would be located between 60 and 80 mm above the mouth of the extract tube 25.

Figure 3:
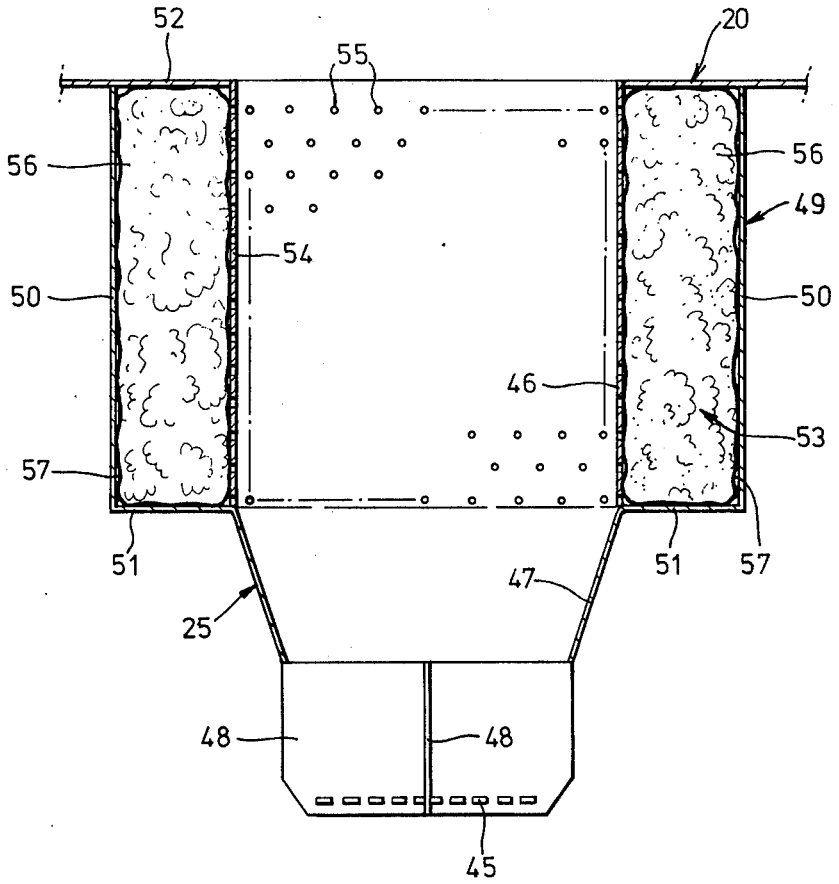
FIG. 3 is a sectional view through another extract tube incorporating an alternative form of sound-deadening means.

FIG. 3 illustrates another embodiment of sound-deadening means for use with a booth similar to that shown in FIG. 1.

In this instance, the extract tubes 25 are of rectangular section and are provided with a baffle or target plate 45 against which the air and water mixture impacts to assist the scrubbing action. Greater detail in the construction of the plate 45 may be found in U.S. Pat. No. 3,934,495, Bloomer. The extract tube 25 comprises downwardly-depending wall members forming a straight-sided upper portion 46 and a diverging throat portion 47 which terminates in support plates 48 disposed in a cruciform arrangement and supporting the target plate 45. The upper straight-sided portion 46 is provided with sound-deadening means comprising a sound-reflecting jacket 49 formed by an outer wall 50 which extends completely around the upper portion 46 of the tube 25, and a continuous lower wall 51. The continuous upper wall 52 of the jacket 50 is formed by the lower surface of the sub-floor 20.

The jacket 49 forms, with walls 54 of the extract tube 25, an enclosure 53, and the walls 54 are perforated, in the manner of the inner wall 38 of the embodiment illustrated in FIG. 2, to allow for sound penetration into this enclosure. The perforations 55 are in this case 3 mm in diameter and spaced to give walls 54 a 30% free area, although these figures are by way of example only as other sizes and distributions would also be suitable; for example the walls 54 may be made of the same range of materials as the inner wall 38 in FIG. 2. The enclosure 53 is filled with an acoustic material 56 of the same or similar nature to that described and shown at 36 in FIG. 2. As wetting of the acoustic material 56 substantially reduces its efficiency, the material is enclosed in a water-impervious envelope 57 made for example of a membraneous plastics or film material such as MELINEX which does not materially inhibit sound-absorption but which prevents water ingress into the material 56.

The sound-deadening means of FIG. 3 operates in a similar manner to that described in connection with FIG. 2. Sound passing up the tubes 25 penetrates the perforated walls 54 and passes into the sound-absorbing material 56 where some is absorbed immediately; sound passing through the material is reflected at the inside surfaces of the casing walls 50 back into the material, where further attenuation takes place. Again, noise reductions of a minimum of 3 dB(A) have been achieved using this construction, and selective frequencies can be absorbed by varying the density or composition of the sound-absorbing material 56. Generally speaking, high density materials are effective in absorbing low frequencies, and low density materials are employed to reduce the higher frequencies; for maximum efficiency a combination of high and low density materials are therefore included.

The waterproof envelope 57 shown in FIG. 3 inevitably results in some reduction, however small, in the sound-deadening qualities of the acoustic material 56. The use of this envelope can however be rendered optional by employing more sophisticated forms of apertured metal sheet to form the downwardly-depending walls 54 of the extract tubes themselves. An example of the use of such a material is shown in FIG. 4.

Figure 4:
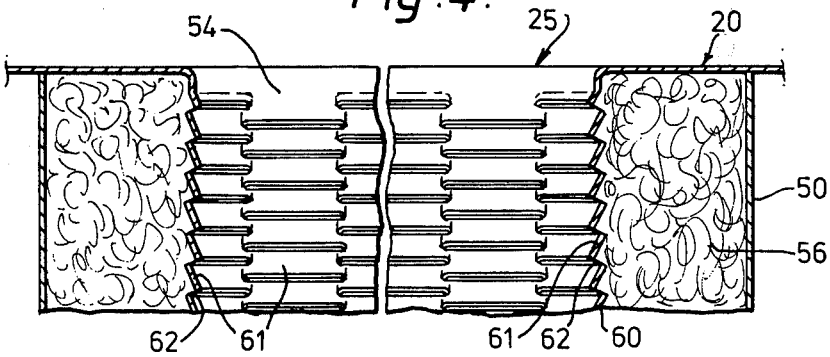
FIG. 4 is a sectional view through part of another extract tube.

In FIG. 4, the walls 54 of the tube 25 are formed from an apertured metal sheet 60 in which the openings in the sheet are initially formed as short, horizontal slits arranged in staggered vertical rows. The metal between the slits is then deformed to enlarge the slits and to provide a multitude of adjacent slats 61 each extending over a respective aperture 62. The lower edge of each slat 61 extends inwardly of the tube walls beyond the respective aperture 62.

During operation of the booth, water passing downwardly through the tube 25 is prevented from entering the apertures in the walls 54 by the overhanging lower edges of slats 61. As a result, the protective envelope 57 (FIG. 3) can be dispensed with. It will be appreciated that the downwardly-directed openings 62 also help to trap sound passing upwardly through the tube 25.

Other forms of apertured sheet metal may also be used for the walls of the tube 25. For example, sheets may be used which are slit in the same way as sheet 60 and which are then bent to form overhanging semi-circular "eyelids" above each slit and similar semi-circular recesses below each slit extending in the opposite direction.

It will be appreciated that variations of the embodiments described hereinbefore with reference to the drawings can be provided. For example, it is not essential that the jacket 50 and sound-absorbing material 56 extend completely around the tube 25; instead they may extend only partially around the tube e.g. on two opposite sides, and if the tube is rectangular, only the respective wall members need be perforate. In this form, the baffle plates may for example be applied to an outlet structure which is in the form of a continuous slot having spaced, downwardly-depending side walls rather than a series of extract tubes. In place of the individual sound attenuators 33 described in connection with FIGS. 1 and 2, elongate, channel-section baffles may be provided running either parallel to the longitudinal axis of the booth or transverse to said axis. Such baffles may for example comprise an inverted U-section, the open side of which faces the extract slot or tubes. This open side can be closed by a lower wall of a perforate sheet material such as that shown at 54 in FIG. 3 or at 38 in FIG. 2, and the space defined between the upper and lower walls filled with the sound-absorbing material.

The underside of the attenuator or baffle may be shaped to provide least resistance to air flow.

I claim:

1. A paint spray booth comprising an enclosed chamber defining a working area, a perforate working floor, means for supplying air to the working area and for causing a flow of air from the working area downwardly through the perforate working floor, a sub-floor beneath and spaced from the perforate working floor, means for continuously flooding the sub-floor with a scrubbing liquid and one or more openings in the sub-floor through which the scrubbing liquid and air can be extracted; and sound-deadening means operable to reduce noise levels within the working area during operation of the booth, said sound-deadening means being located below the perforate working floor and comprising sound-reflecting baffle means and, disposed adjacent at least one surface thereof, a sound-absorbing material said sound reflecting baffle means comprising a baffle plate located between the working floor and the sub-floor above the entrance to said opening or openings therein, and the sound absorbing material comprising a layer of acoustic material supported against the face of the baffle plate nearest said opening or openings.

2. A paint spray booth as claimed in claim 1, wherein said baffle plate comprises an inverted conical member.

3. A paint spray booth as claimed in claim 2, wherein a series of said members are disposed in spaced relation in a substantially horizontal plane between the working floor and the sub-floor.

4. A paint spray booth as claimed in claim 3, wherein each member is tilted about its longitudinal axis to reduce resistance to air flow from the working floor towards the opening or openings in the sub-floor.

5. A paint spray booth as claimed in claim 1, wherein the sub-floor is provided with a series of spaced extract openings therein, and said sound-deadening means comprises a plurality of individual noise attenuators each located above a corresponding extract opening, and wherein said baffle plate forms the outer casing of the attenuator which casing defines an enclosure open at the base thereof and reducing in cross-section towards its upper end, and said acoustic material is disposed within said enclosure.

6. A paint spray booth as claimed in claim 5, wherein said casing is at least substantially conical.

7. A paint spray booth as claimed in claim 1 wherein said sound-absorbing material is retained in position adjacent said baffle means by a lower wall member of perforate sheet material.

8. A paint spray booth as claimed in claim 1 wherein liquid supply means are provided operable to flood the outer surfaces of the baffle plate or plates with scrubbing liquid during operation of the booth to prevent contamination with paint solids.

9. In a paint spray booth of the type comprising a work area having sidewalls and a perforate floor, a sub-floor beneath and spaced from the perforate floor, means for flooding the sub-floor with a paint removing liquid such as water, at least one constricted passage through the sub-floor having at least one downwardly extending surface to define a scrubber in which overspray from the work area is intermixed with and transferred substantially to the liquid, and air moving means to cause a substantial flow of air from the work area to and through the constricted passage, the improvement which comprises:

means forming a sound absorbing chamber externally adjacent and substantially coextensive with said downwardly extending surface, sound absorbent material within said sound absorbing chamber, perforations in and through said surface to permit sound in said constricted passage to be absorbed by said material, and water impervious means between said surface and said sound absorbing material to prevent said liquid from contacting said sound absorbing material.

10. A paint spray booth as claimed in claim 9, wherein the sub-floor is formed with a plurality of spaced openings each of which terminate in an outlet structure comprising an extract tube having downwardly-depending walls, and said means forming a sound-absorbing chamber comprises an outer jacket surrounding at least some of the wall area of the extract tube, the acoustic material being disposed in the space defined between the walls of the tube and the jacket.

11. A paint spray booth as claimed in claim 10, wherein each said extract tube and the respective jacket are of circular cross-section and said tube and jacket are arranged co-axially.

12. A paint spray booth as claimed in claim 9, wherein the acoustic material is enclosed within an envelope of waterproof material.

13. A paint spray booth as claimed in claim 9, wherein each downwardly-depending wall member is formed from sheet material which is shaped around the apertures therein to prevent the scrubbing liquid which travels downwardly via the respective opening from passing through said apertures.

* * * * *